US006516766B2

(12) United States Patent
Kotani et al.

(10) Patent No.: US 6,516,766 B2
(45) **Date of Patent: *Feb. 11, 2003**

(54) ROCKER ARM

(75) Inventors: Kazuyuki Kotani, Oume (JP); Kazuo Uchida, Oume (JP)

(73) Assignee: Koyo Seiko Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/899,918

(22) Filed: Jul. 9, 2001

(65) Prior Publication Data

US 2002/0092491 A1 Jul. 18, 2002

Related U.S. Application Data

(60) Continuation-in-part of application No. 09/506,835, filed on Feb. 18, 2000, now Pat. No. 6,283,077, which is a division of application No. 09/059,256, filed on Apr. 14, 1998, now Pat. No. 6,041,747.

(30) Foreign Application Priority Data

Apr. 23, 1997 (JP) ..... 9-106096
Apr. 23, 1997 (JP) ..... 9-106097

(51) Int. Cl.[7] ..... F01L 1/18
(52) U.S. Cl. ..... 123/90.39; 123/90.41
(58) Field of Search ..... 123/90.39, 90.41; F01L 1/18

(56) References Cited

U.S. PATENT DOCUMENTS

| | | | | |
|---|---|---|---|---|
| 1,449,611 A | | 3/1923 | Konigslow | |
| 2,478,130 A | | 8/1949 | Ronfeldt | |
| 3,020,779 A | | 2/1962 | Winter, Jr. | |
| 3,374,690 A | | 3/1968 | Hirose | |
| 4,825,717 A | * | 5/1989 | Mills | 123/90.39 |
| 5,010,857 A | | 4/1991 | Hempelmann et al. | |
| 5,063,889 A | * | 11/1991 | Pryba et al. | 123/90.39 |
| 5,123,384 A | * | 6/1992 | Abbas | 123/90.39 |
| 5,195,475 A | | 3/1993 | Murphy et al. | |
| 5,437,209 A | | 8/1995 | Santoro | |
| 5,671,707 A | | 9/1997 | Purcell et al. | |
| 5,774,984 A | | 7/1998 | Kotani | |
| 5,887,474 A | | 3/1999 | Cutshall et al. | |
| 6,283,077 B1 | * | 10/2001 | Kotani et al. | 123/90.39 |

FOREIGN PATENT DOCUMENTS

| | | | | |
|---|---|---|---|---|
| EP | 074875 | * | 3/1983 | F01L/1/18 |
| JP | U58152503 | | 10/1983 | |
| JP | A63272903 | | 11/1988 | |

* cited by examiner

*Primary Examiner*—Thomas Denion
*Assistant Examiner*—Jaime Corrigan
(74) *Attorney, Agent, or Firm*—Birch, Stewart, Kolasch & Birch LLP

(57) ABSTRACT

A rocker arm is tilted by a cam so as to open and close a valve provided on a cylinder head. This arm comprises a pair of opposing wall portions which are made by folding a flat plate so that they oppose substantially in parallel and cylindrical expanding portions which are formed at tilting fulcrum shaft mounting portions located in a center of the opposing wall portions in the length direction thereof, the expanding portions being expanded in the direction of the tilting fulcrum shaft. The cylindrical expanding portions which are thicker than the opposing wall portions receive a load accompanied by the tilting motion so as to decrease bearing stress applied to the opposing wall portions.

16 Claims, 11 Drawing Sheets

ROCKER ARM

This application is a continuation-in-part application Ser. No. 09/506,835 filed on Feb. 18, 2000, now U.S. Pat. No. 6,283,077 which is a Divisional of application Ser. No. 09/059,256 filed on Apr. 14, 1998 now U.S. Pat. No. 6,041,747. The entire contents of each of the above Applications are hereby incorporated by reference.

BACKGROUND OF THE INVENTION

1. Field of the Invention

This invention relates to a rocker arm of center pivot type or end pivot type, which is actuated by a cam in valve operation of an engine so as to open/close a valve provided on a cylinder head. In the rocker arm of the present invention, its major parts are produced by sheet metal processing.

2. Description of the Related Art

A conventional center pivot type rocker arm made of sheet metal has been disclosed in Japanese Unexamined Patent Application No. Sho 58-152503.

This conventional rocker arm will be described. In this rocker arm, one ends thereof are free and the other ends are connected with each other. The opposing wall portions are separated from each other at a distance such that the inside walls opposes each other. The opposing wall portions of this pair are produced by folding one end of a single belt-like flat metal at 180° relative to the other end at the center thereof in the length direction. Each of the opposing wall portions has a through hole at the middle point in the length direction of each wall portion. A cylindrical bushing is inserted through the through holes of the opposing wall portions and fixed there. A tilting fulcrum shaft is inserted into a hole of the bushing. The conventional rocker arm has such a structure. The tilting fulcrum shaft is supported by a cylinder head or the like.

In the aforementioned rocker arm bushing, one end thereof has a flange extending outward in the diameter direction so as to fit to an outside wall surface of one opposing wall portions. After this bushing is inserted into the through holes formed in the opposing wall portions of the pair, the other end of the bushing is caulked toward the outside wall surface of the other opposing wall portion.

In the conventional rocker arm, a load accompanied by the tilting motion of the tilting fulcrum shaft is applied to the through holes in the opposing wall portions through the bushing. Thus, an excessive bearing stress is applied to the through holes of the opposing wall portions. Therefore, this structure has a possibility that the opposing wall portions may be deformed with a passage of time so that a looseness occurs in the rocker arm.

Another conventional end pivot type rocker arm made of sheet metal has been disclosed in Japanese Unexamined Patent Application No.P63-272903.

In this rocker arm, one ends thereof are free and the other ends are connected with each other. The opposing wall portions are separated from each other at a distance such that the inside walls opposes each other. The opposing wall portions of this pair are produced by folding one end of a single belt-like flat metal at 180° relative to the other end at the center thereof in the length direction.

A roller is rotatably supported at the middle of each of the opposing wall portions in the length direction in such a manner that a cam is in rolling contact with the roller. Chip members are attached to the free ends of the opposing wall portions so that they contact top end of a valve. The other ends of the opposing wall portions are curved in a cylindrical shape such that the curved portion is closed. To facilitate understanding, the cylindrical curve structure will be described more. This structure is the same as a structure formed by curving a single sheet metal in a cylindrical shape and then welding together both ends of the sheet metal. An internal surface of this cylindrical curved portion is threaded and a pivot shaft is fit to this cylindrical curved portion.

As described above, in the conventional rocker arm, the cylindrical curved portion of the other end of the opposing wall portions is formed by only bending the belt-like sheet metal and welding together both the opposing wall portions so as to form a closed structure. Thus, there is a high possibility that that cylindrical curved portion may be deformed by a twisting moment which repeatedly occurs accompanied by the tilting motion so that the connecting portion of the curved portion is peeled off. To eliminate an occurrence of this peeling, there may be available a method in which a thickness of the opposing wall portions is increased so as to increase sectional area of the connecting portion thereby intensifying stiffness against a torsion moment. However, in this method, it is difficult to reduce the weight of the rocker arm and further achieve bending work of a high accuracy because of high stiffness.

SUMMARY OF THE INVENTION

Accordingly, an object of the present invention is to provide a rocker arm having a high reliability so as to enable achieving of a long-term stable action.

Another object of the invention is to provide a rocker arm having a high supporting stiffness for a tilting fulcrum shaft in the opposing wall portions.

Still another object of the invention is to provide a rocker arm having a high stiffness against a torsion without increasing the thickness of the opposing walls.

The other objects, features and advantage of the invention will be evident from a following description.

To achieve the above object, according to one aspect of the present invention, there is provided a rocker arm comprising: a rocker arm main body; a cam receiver; and a tilting fulcrum shaft, the rocker arm main body having a pair of opposing wall portions which are tilted by a cam so as to actuate a valve, the opposing wall portions each containing at least a cam receiver mounting portion for mounting the cam between the opposing wall portions and a tilting fulcrum shaft mounting portion for mounting the tilting fulcrum shaft between the opposing wall portions, each of the tilting fulcrum shaft mounting portion having cylindrical expanding portion which is projected out of the wall surface of the opposing wall portions in the axial direction of the tilting fulcrum shaft being mounted.

According to another aspect of the invention, there is provided a rocker arm comprising: a rocker arm main body; a cam receiver; and a tilting fulcrum shaft, the rocker arm main body having a pair of opposing wall portions which are tilted by a cam so as to actuate a valve, the opposing wall portions each containing at least a cam receiver mounting portion for mounting the cam between the opposing wall portions, the cam receiver mounting portion being provided at one end of the rocker arm main body, and a tilting fulcrum shaft mounting portion for mounting the tilting fulcrum shaft between the opposing wall portions, the tilting fulcrum shaft mounting portion being located between both ends of the rocker arm main body, each of the tilting fulcrum shaft mounting portion having cylindrical expanding portion which is projected out of the wall surface of the opposing wall portions in the axial direction of the tilting fulcrum shaft being mounted.

According to still another aspect of the invention, there is provided a rocker arm comprising: a rocker arm main body; a cam receiver; a valve receiver; and a tilting fulcrum shaft, the rocker arm main body having a pair of opposing wall portions which oppose each other and a valve receiver mounting portion for mounting the valve receiver located at the other ends of the opposing wall portions, the opposing wall portions each having at least a cam receiver mounting portion for mounting the cam receiver, which is located at one end thereof and a tilting fulcrum shaft mounting portion for mounting the tilting fulcrum shaft between the opposing wall portions, which is located between both ends thereof, the valve receiver mounting portion having a cylindrical curved portion and connecting portions which are joined by closing the cylindrical curved portion, the connecting portions having bent portions which are joined to each other.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects as well as advantages of the invention will become clear by the following description of preferred embodiments of the invention with reference to the accompanying drawings, wherein.

In all these figures, like components are indicated by the same numerals.

DETAILED DESCRIPTION OF THE PREFERRED EMBODIMENTS

Hereinafter, the preferred embodiments of the present invention will be described with reference to the accompanying drawings.

(First Preferred Embodiment of the Present Invention)

Figure 1:
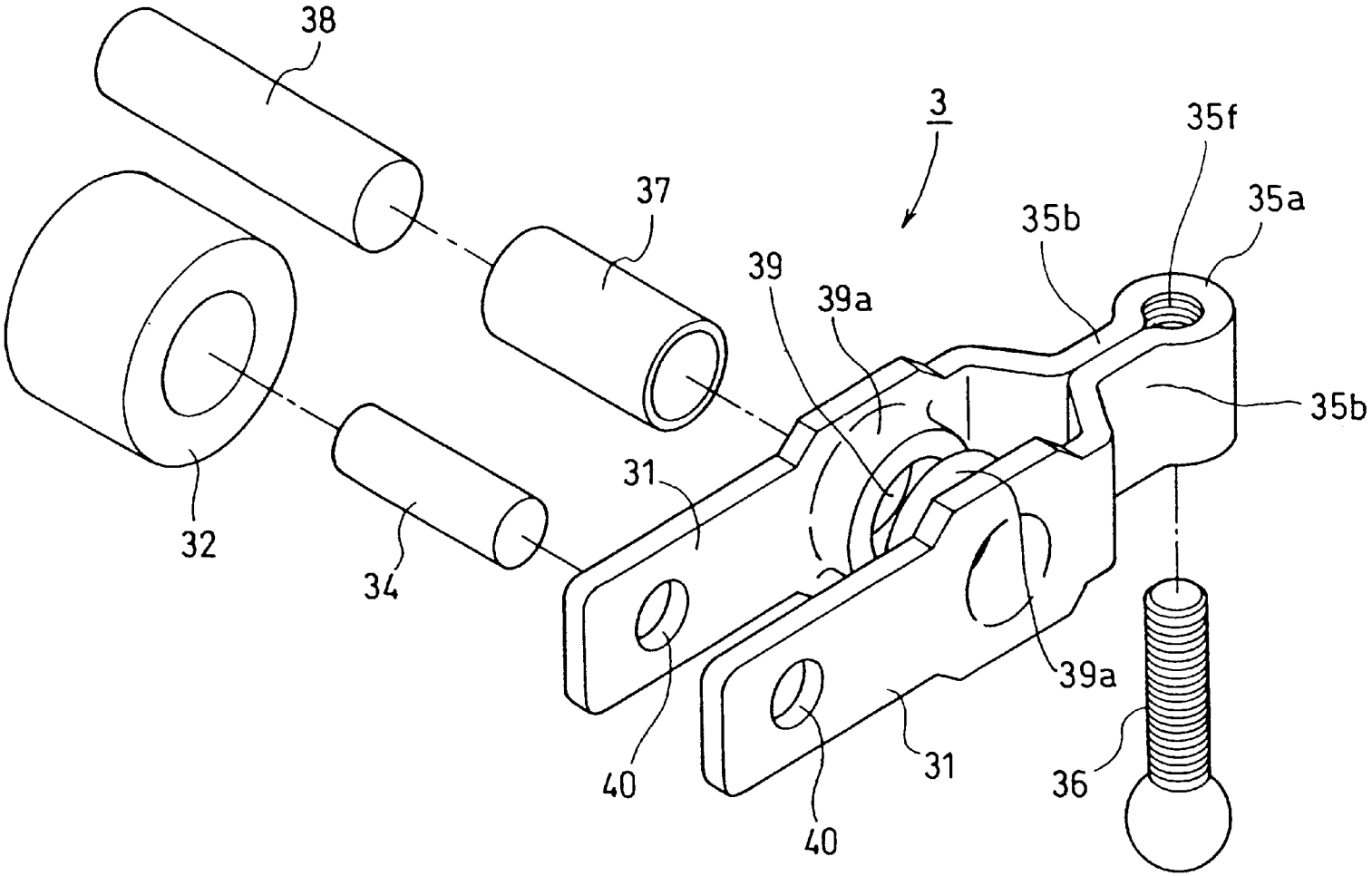
FIG. 1 is a disassembled perspective view of a rocker arm according to a first preferred embodiment of the present invention.
Figure 2:
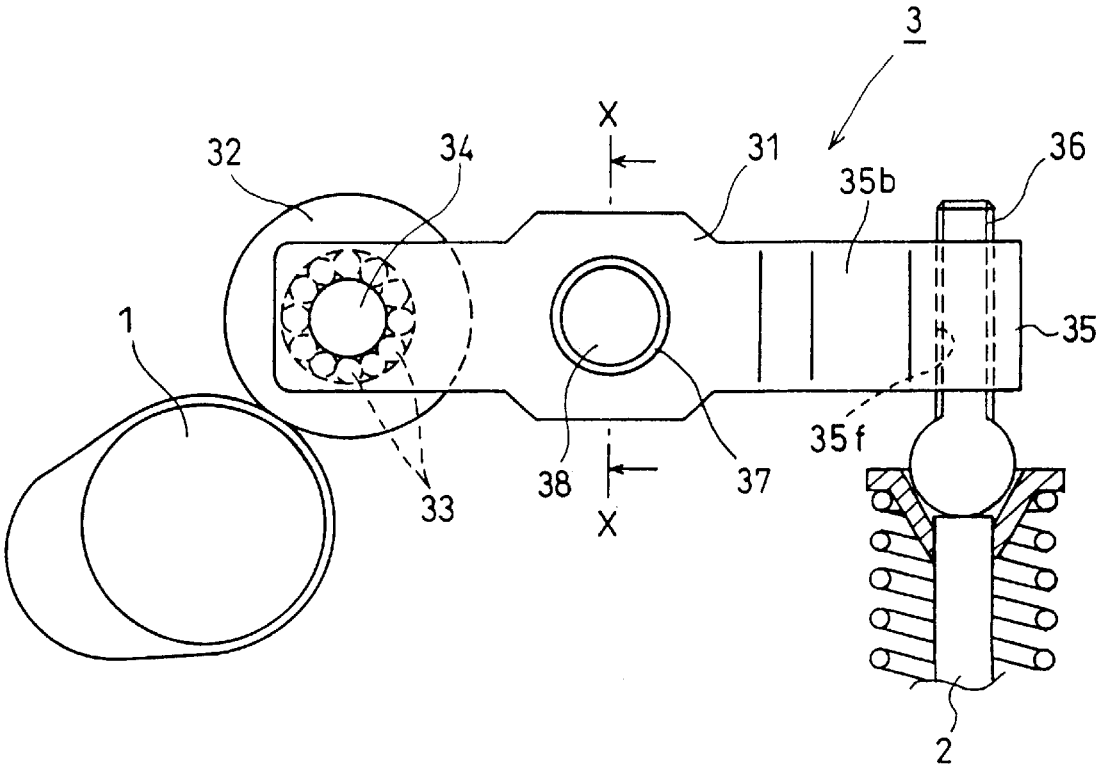
FIG. 2 is a side view of a rocker arm according to the first embodiment thereof.
Figure 3:
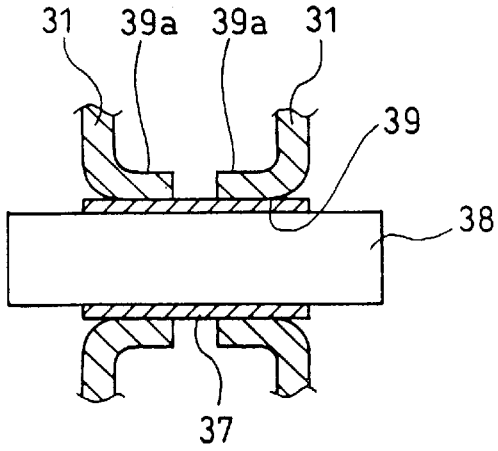
FIG. 3 is a view taken along the line X—X of FIG. 2.

A rocker arm according to a first preferred embodiment of the present invention will be described with reference to FIGS. 1–3. A rocker arm 3 according to the first embodiment of the present invention is located between a cam 1 and a valve 2 so as to transmit motion of the cam 1 to the valve 2.

This rocker arm 3 has a pair of opposing wall portions 31, 31. Both of the opposing wall portions 31, 31 are disposed so as to be parallel to or almost parallel to each other. Each end of both of the opposing wall portions 31, 31 is a free end each having a mounting shaft hole 40, which acts as a cam receiving portion. A roller 32 for receiving the cam is installed in the mounting shaft holes 40 of the free ends of the opposing wall portions 31, 31 through a plurality of needle rollers 33. The roller 32 is located between the free ends of the opposing wall portions 31, 31 and receives the cam 1 so that the cam 1 is in rotating contact with the surface of the roller 32. The other end of the pair of the opposing wall portions 31, 31 acts as a valve receiver mounting portion, which has a pipe-like, preferably cylindrical curved portion 35*a* and connecting portions 35*b*, 35*b* for closing a shaft hole 35*f* in the curved portion 35*a*. A screw shaft 36 is fit into this curved portion 35*a* so as to receive the valve.

This screw shaft 36 is in contact with a top end of the valve 2 for receiving the valve 2. The opposing wall portions 31, 31 have mounting shaft holes 39, 39 for mounting a tilting fulcrum shaft, which is located in the middle point in the length direction thereof. These shaft holes 39, 39 have tube-like or preferably cylindrical expanding portions 39*a*, 39*a* which expand in the direction of the tilting fulcrum shaft. The respective expanding portions 39*a*, 39*a* are expanded toward each of the opposing inside walls of the opposing wall portions 31, 31 from each of the inside wall portions. Between the shaft holes 39 and 39 of the opposing wall portions 31, 31 is installed a tilting fulcrum shaft 38 through a hollow shaft 37 which is a cylindrical member. At this time, the tilting fulcrum shaft 38 is supported by the respective expanding portions 39*a*, 39*a*.

According to this specification, the valve receiver mounting portion comprising the curved portion 35*a* and connecting portions 35*b*, 35*b* is formed on the other end of the aforementioned pair of the opposing wall portions 31, 31. This valve receiver mounting portion is referred to as a rocker arm main body together with the aforementioned opposing wall portions 31, 31. On this rocker arm main body, the roller 32 and tilting fulcrum shaft 38 are installed on the opposing wall portions 31, 31 and the screw shaft 36 is fit to the valve receiver mounting portion.

With such a structure, in the rocker arm 3, its free end thereof is moved synchronously with a motion of the cam 1 with the tilting fulcrum shaft 38 as a tilting fulcrum, so as to drive the valve 2 on the other end. The tilting fulcrum shaft 38 is supported by a cylinder head or the like (not shown).

The hollow shaft 37 is inserted in between the shaft holes 39 and 39 so that both ends thereof are fixed, and then the tilting fulcrum shaft 38 is inserted into the hollow shaft 37 such that it is rotatable relative thereto. The hollow shaft 37 is made of steel tube material or such material having self-lubrication as copper alloy. The expanding portions 39, 39 provided on the periphery of the shaft holes 39, 39 are projected inward and serve for installing the tilting fulcrum shaft 38. Then, a production method of the aforementioned rocker arm will be described.

First, the opposing wall portions 31, 31 are produced. For this purpose, a sheet of metal plate is punched to a predetermined shape. The expanding portions 39, 39 are formed by drawing predetermined positions of the metal plate so as to produce cylindrical expanding portions having a bottom and then the bottoms are punched out. As a result, the expanding portions 39 are formed. Further, the free ends of the opposing wall portions 31, 31 are punched in a circular shape so as to produce the mounting shaft holes 40, 40 for a support shaft 34 for the roller 32.

To form the opposing wall portions 31, 31, the metal plate is folded at a middle point in the length direction thereof. This folding fulcrum portion becomes the other end side of the opposing wall portions 31, 31. This folding fulcrum portion is curved in a cylindrical shape so as to form the curved portion 35*a* and then, the adjacent portions are closed so as to form the connecting portions 35*b*, 35*b* so that the opposing wall portions 31, 31 are arranged so as to oppose each other in parallel thereto. To close the curved portion 35*a* firmly, the connecting portions 35*b*, 35*b* are welded to each other and at the same time, an internal surface of the curved portion 35*a* is threaded.

Next, the hollow shaft 37 is inserted into each of the expanding portions 39*a*, 39*a* of the opposing wall portions 31, 31 by pressing or shrink fitting. Further, the screw shaft 36 is screwed into the curved portion 35*b* from below. The hollow shaft 37 may be fixed by welding or caulking end portions of the hollow shaft 37.

After that, the support shaft 34 around which the roller 32 is mounted is fixed between the mounting shaft holes 40 and 40 in the free ends of the opposing wall portions 31, 31 by pressing or shrink fitting of both ends of the support shaft 34. This support shaft may be fixed by welding or caulking the shaft ends of the support shaft 34.

As described above, in the rocker arm 3 according to the first embodiment of the present invention, the expanding portions 39*a*, 39*a* are provided around the shaft holes 39, 39 of the opposing wall portions 31, 31 and then the hollow shaft 37 is installed between the shaft holes 39 and 39, and between the expanding portions 39*a* and 39*a*. The tilting fulcrum shaft 38 is inserted into this hollow shaft 37. Thus, a load during the tilting motion can be received by the expanding portions 39*a*, 39*a* which are thicker than the opposing wall portions 31, 31. Therefore, bearing stress applied to the opposing wall portions 31, 31 can be reduced as compared to the conventional art, so that the supporting stiffness of the opposing wall portions 31, 31 for supporting the tilting fulcrum shaft 38 can be intensified. As a result, the expanding portions 39*a*, 39*a* are unlikely to be deformed in a long term thereby preventing looseness of the rocker arm.

Figure 4:
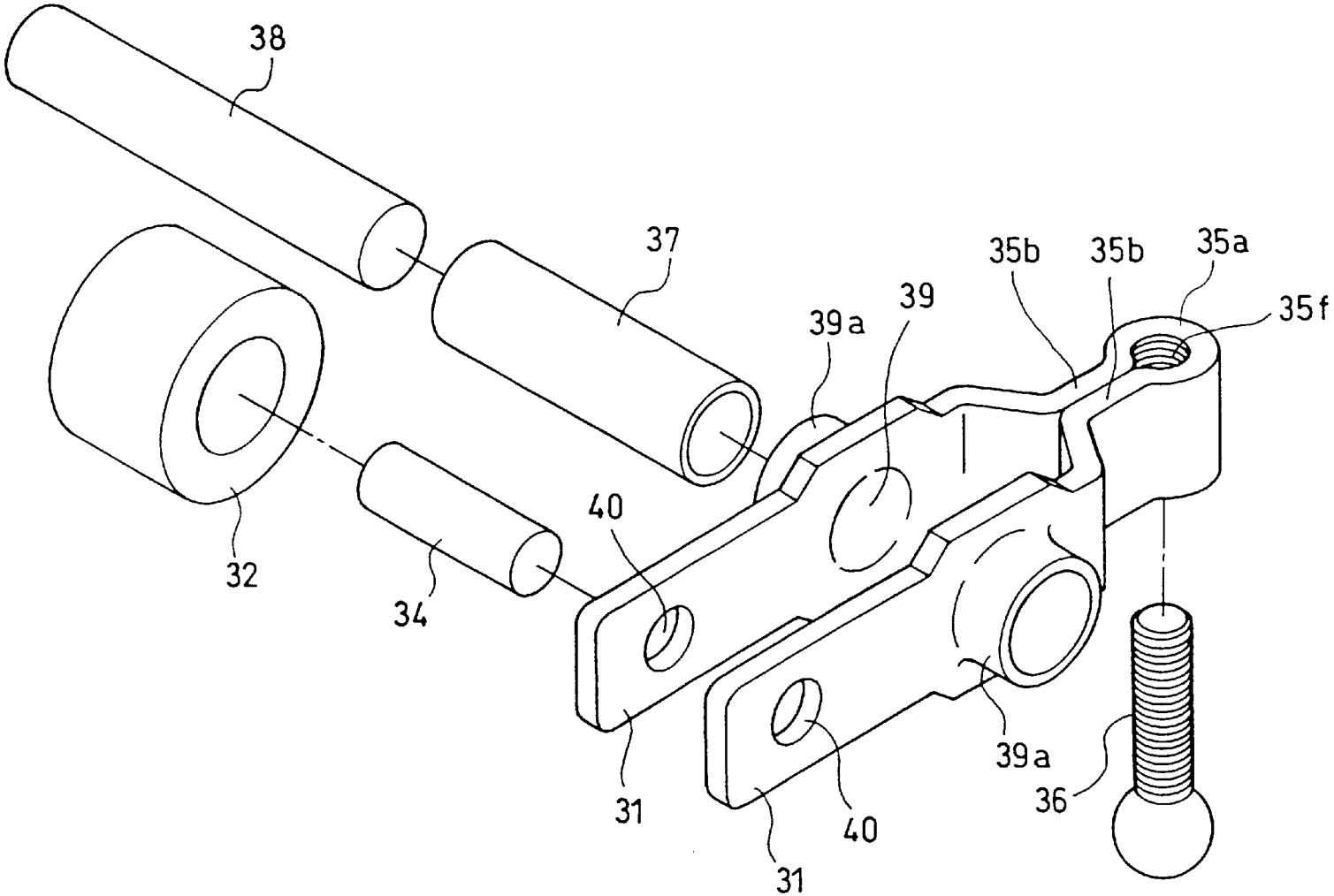
FIG. 4 is a disassembled perspective view of a rocker arm showing a modification of cylindrical expanding portions.
Figure 5:
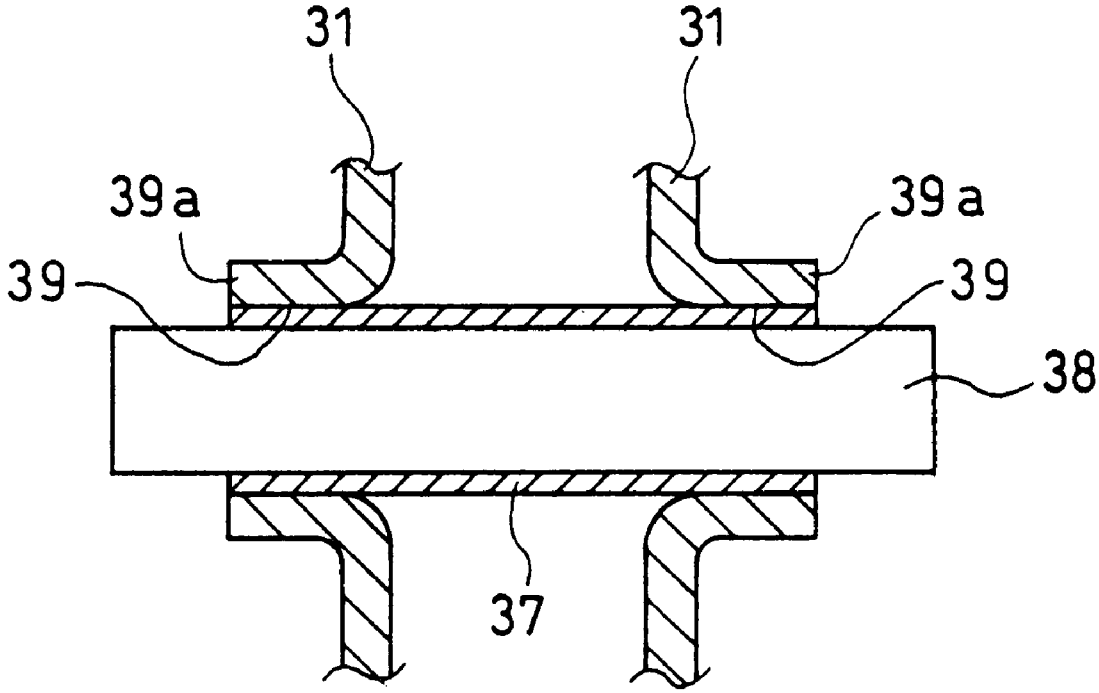
FIG. 5 is a sectional view of opposing wall portions at the cylindrical expanding portions of FIG. 4, corresponding to FIG. 3.

Although according to the first embodiment, the expanding portions 39*a*, 39*a* are projected inwardly of the opposing wall portions 31, 31, it is permissible to project the expanding portions 39*a*, 39*a* outwardly of the opposing wall portions 31, 31 as shown in FIGS. 4, 5.

Figure 6:
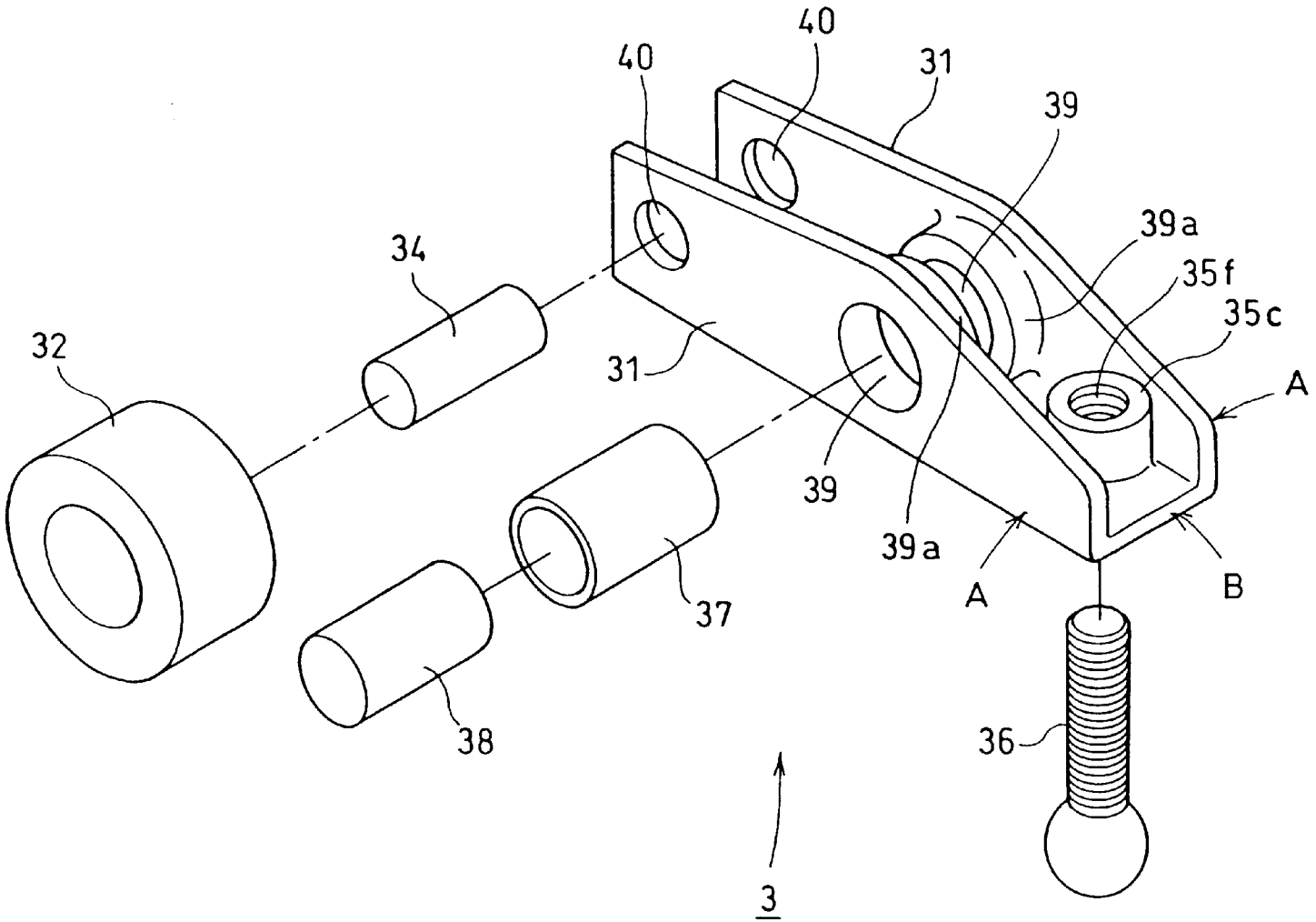
FIG. 6 is a perspective view of a rocker arm showing a modification of the opposing wall portions.
Figure 7:
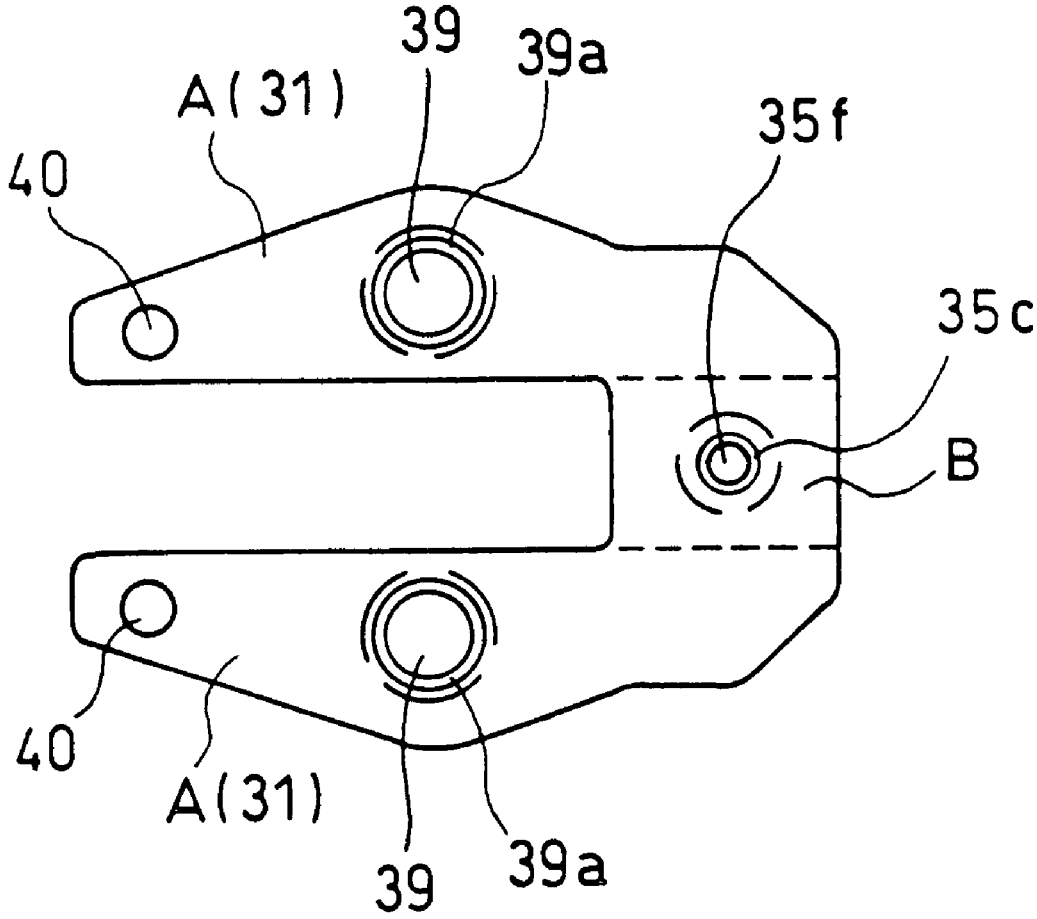
FIG. 7 is a plan view showing a punched shape prior to folding of the opposing wall portions of FIG. 6.

The present invention is not restricted to the shape of the rocker arm 3 according to the first embodiment described above, but it is permissible to form the opposing wall portions 31, 31 with side walls A, A which rise vertically on both sides from a bottom wall B by folding a single flat plate as shown in FIG. 6. In producing the rocker arm having the opposing wall portions 31, 31 from this flat plate as shown in FIG. 6, when the metal plate is punched in a substantially U shape as shown in FIG. 7, the expanding portions 39*a*, 39*a* are formed in the center of the side walls A, A which are the opposing wall portions 31, 31 in the length direction thereof, then the circular mounting shaft holes 40, 40 which serve as the cam receiver mounting portion are formed in the free ends of the side walls A, A, and the expanding portion 35*c* which is a mounting portion for the screw shaft 36 for receiving the valve is formed on the bottom wall B. Then, the two side walls A, A of this metal plate are bent vertically along dotted line of the bottom wall B which is a connecting portion thereof. As a result, the opposing wall portions 31, 31 are formed of the side walls A, A. Then, the roller 32, screw shaft 36 and hollow shaft 37 are installed as described above. In the rocker arm 3 shown in FIG. 6, the valve receiver mounting portion is not provided on the opposing wall portions 31, 31, but formed on the bottom wall B. In the rocker arm 3 shown in FIG. 6, the process for welding the connecting portions 35*a*, 35*a* on the other ends of the opposing wall portions 31, 31 is not necessary, so that production cost can be reduced.

Figure 14:
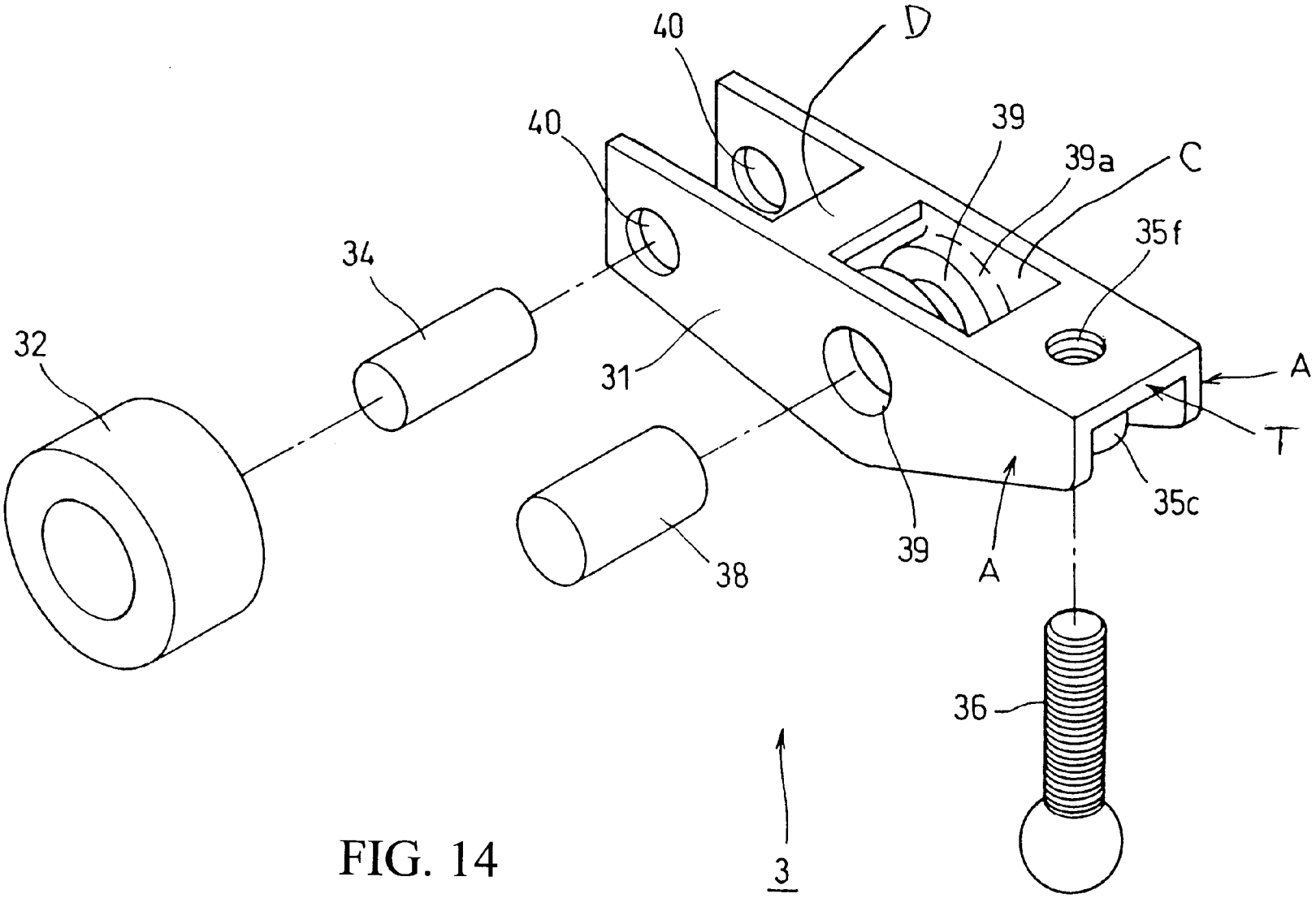
FIG. 14 is a perspective view of a rocker arm showing another modification of the opposing wall portions according to the first embodiment illustrated in FIG. 1.
Figure 15:
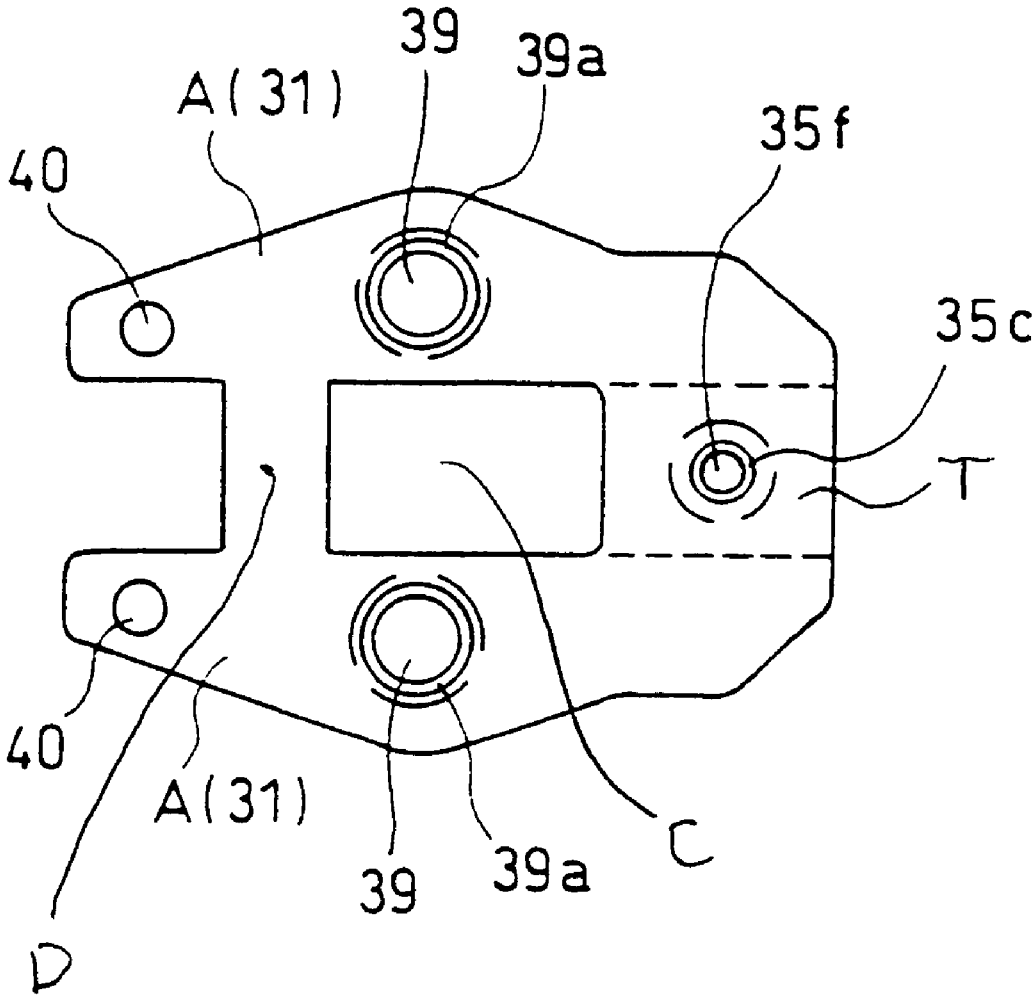
FIG. 15 is a plan view showing a punched shape prior to folding of the opposing wall portions of FIG. 14.

Referring to FIGS. 14 and 15, an alternative modification of the first embodiment of the present invention is illustrated. Specifically, the single flat plate of FIG. 6 is folded in an opposite direction. Referring to FIGS. 14 and 15, opposing wall portions 31, 31, with side walls A, A which descend vertically on both sides from a top wall T, are formed by folding a single flat plate. In producing the rocker arm having the opposing wall portions 31, 31 from this flat plate as shown in FIG. 14, when the metal plate is punched in a substantially U shape as shown in FIG. 15, the expanding portions 39*a*, 39*a* are formed in the center of the side walls A, A which are the opposing wall portions 31, 31 in the length direction thereof, then the circular mounting shaft holes 40, 40 which serve as the cam receiver mounting portion are formed in the free ends of the side walls A, A, and the expanding portion 35*c* which is a mounting portion for the screw shaft 36 for receiving the valve is formed on the top wall T. Then, the two side walls A, A of this metal plate are bent vertically along the dotted line of the top wall T which is a connecting portion thereof. As a result, the opposing wall portions 31, 31 are formed of the side walls A, A. Then, the roller 32, screw shaft 36 and hollow shaft 37 are installed as described above. In the rocker arm 3 shown in FIG. 14, the valve receiver mounting portion is not provided on the opposing wall portions 31, 31, but is formed on the top wall T. In the rocker arm 3 shown in FIG. 14, the process for welding the connecting portions 35*a*, 35*a* on the other ends of the opposing wall portions 31, 31 is not necessary, so that production cost can be reduced.

In addition, the modification illustrated in FIGS. 14 and 15 provides a great effect, since the plate body constituting the rocker arm is formed with a hole, the material cost can be lowered. Furthermore, even though an opening C is provided, a reinforcing member D is also provided astride the opening C. Accordingly, the strength of the rocker arm is not lowered.

(Second Preferred Embodiment of the Present Invention)

Figure 8:
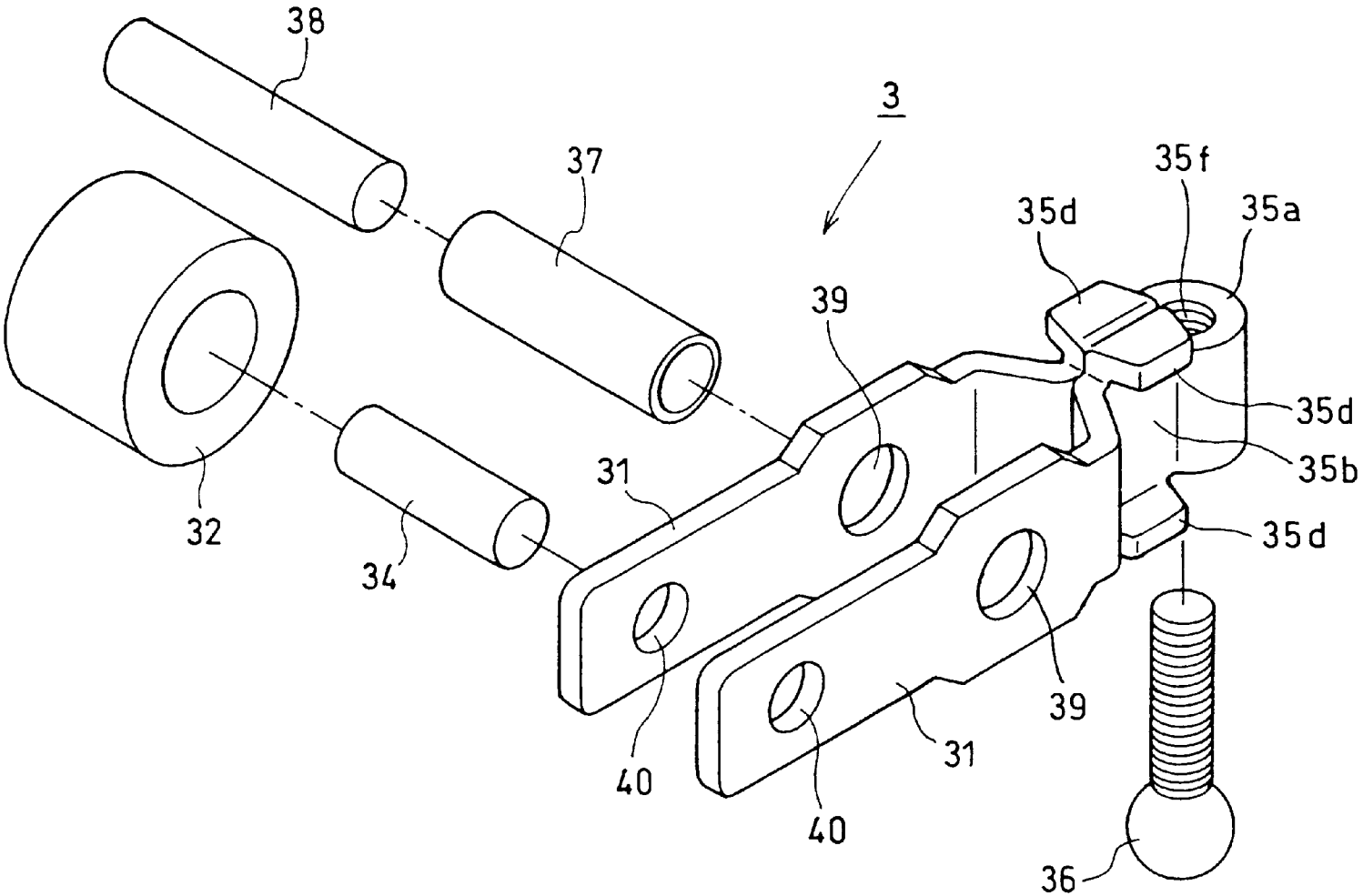
FIG. 8 is a disassembled perspective view of a rocker arm according to a second preferred embodiment of the present invention.
Figure 9:
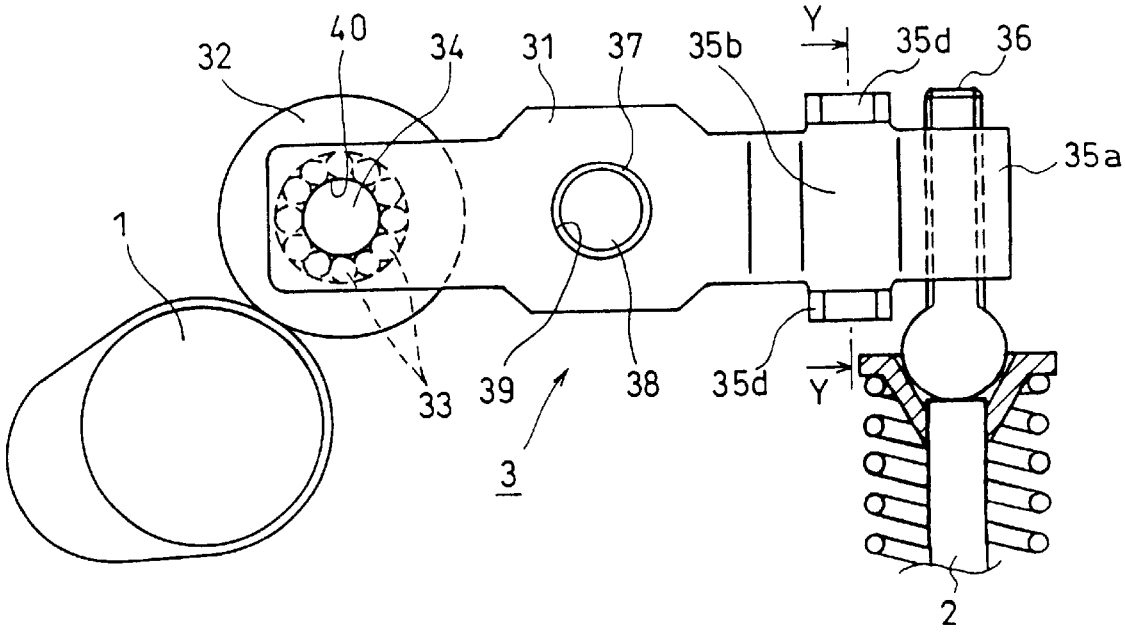
FIG. 9 is a side view of a rocker arm according to the second embodiment.
Figure 10:
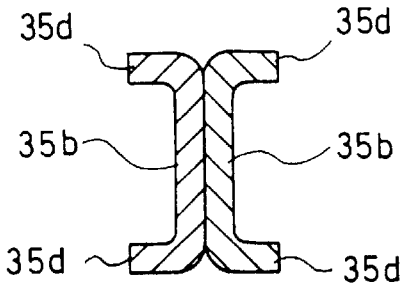
FIG. 10 is a view taken along the lines Y—Y of FIG. 9.

The rocker arm according to a second preferred embodiment of the present invention will be described with reference to FIGS. 8–10. Projecting pieces 35*d*, 35*d* are provided as a part of the curved portion on top and bottom edges of the connecting portions 35*b*, 35*b* at the other ends of the opposing wall portions 31, 31. The projecting pieces 35*d*, 35*d* are bent at 90° relative to each wall surface of the opposing wall portions 31, 31 which form the connecting portions 35*b*, 35*b*. As a result, the connecting portions 35*b*, 35*b* are bent in substantially U shape each so as to produce an H-type steel shape. Thus, its section modulus is increased so that a high stiffness against torsion is ensured.

In the production method of the rocker arm 3, a different point from the first embodiment is that the projecting pieces 35*d*, 35*d* bent at 90° are provided near the center of the opposing wall portions 31, 31 in the length direction thereof and the expanding portions 39*a* are not formed.

As described above, in the rocker arm 3 according to the second embodiment, by forming the connecting portions of the opposing wall portions 31, 31 in so-called H type steel shape, the section modulus of the connecting portion is intensified so as to increase the stiffness against torsion. Thus, even if a torsion moment is applied to the connecting portion repeatedly, the connecting portions 35*b*, 35*b* are never warped like a wave, so that separation of the connecting portions 35*b*, 35*b* can be avoided.

Figure 11:
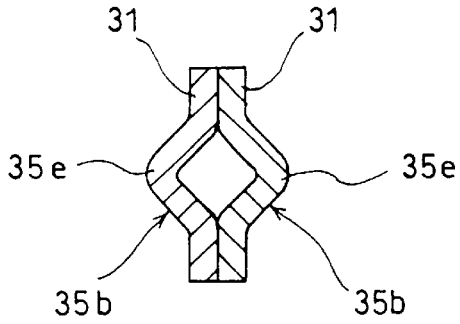
FIG. 11 is a view showing a modification of the connecting portion, corresponding to FIG. 10.
Figure 12:
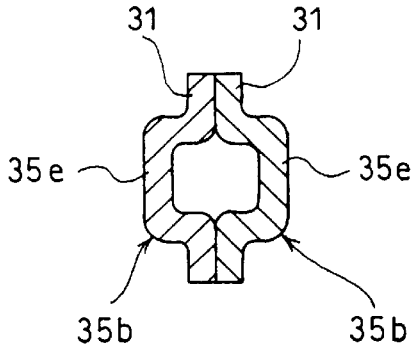
FIG. 12 is a view showing other modification of the connecting portion, corresponding to FIG. 10.

Although the connecting portions 35*b*, 35*b* are provided with the projecting pieces 35*d*, 35*d* so that the entire sectional shape is substantially a U shape, various shapes may be applied as shown in FIGS. 11 and 12. In these shapes, the connecting portions 35*b*, 35*b* are partially or entirely expanded outward in the thickness direction like in a V-shape or U-shape, so that curved expanding portions 35e are produced. Although in such a shape, the contact area of the connecting portions 35*b*, 35*b* is decreased, the section modulus of the connecting portions 35*b*, 35*b* is increased. Therefore, like the second embodiment, the connecting portions become unlikely to be warped like a wave even if a torsion moment is applied thereto so that the connecting portions become difficult to separate from each other.

Figure 13:
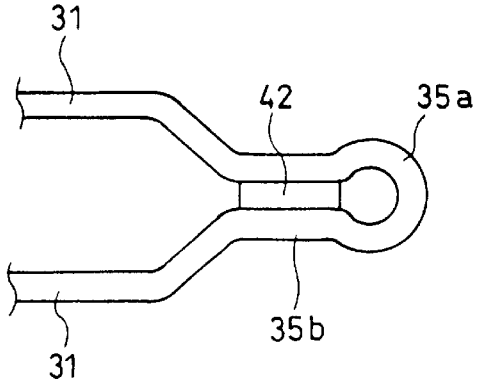
FIG. 13 is a plan view of major parts of the rocker arm in which a spacer is interposed in the connecting portion.

Although in the above embodiment, the opposing wall portions 31, 31 are bent in cross section, it is permissible to fit a spacer 42 between the connecting portions 35*b* and 35*b* and join the three components, that is, the connecting portions 35*b*, 35*b* and the spacer 42 as shown in FIG. 13. In this case, the section modulus is increased by increasing the sectional area without increasing the thickness of the opposing wall portions 31, 31, so that the stiffness against torsion can be intensified.

It is permissible to support the roller 32 of the rocker arm by sliding contact instead of supporting it through a plurality of the needle rollers 33 with respect to the support shaft 34. That is, the roller 32 may be caulked with clearance or fit via. A sliding bearing such as a bushing with respect to the support shaft 34.

Although in the aforementioned rocker arm, the roller 32 is used as the cam receiving portion and the screw shaft 36 is used as the valve receiving portion, it is permissible to substitute them with a chip-like member made of appropriate metal material although not shown here.

Although in the above embodiments, the roller 32 is supported by a plurality of the needle rollers 33 with respect to the support shaft 34, it is permissible to support it by sliding contact instead of supporting through the needle rollers. That is, it is permissible to caulk the roller 32 with a clearance or fit through a sliding bearing such as a bushing.

Although in the aforementioned embodiment, the roller 32 is used as the cam receiving portion and the screw shaft 36 is used as the valve receiving portion, it is permissible to substitute them with a chip-like member made of appropriate metal material although not shown here.

The above rocker arm can be applied to not only the center pivot type but also the end pivot type which has two folded opposing wall portions 31, 31.

While there has been described what is at present considered to be preferred embodiments of this invention, it will be understood that various modifications may be made therein and it is intended to cover in the appended claims all such modifications as fall within the true spirit and scope of this invention.

What is claimed is:

1. A rocker arm comprising: a rocker arm main body; a cam receiver being drivable by cams mounted to a cam shaft of an engine; and a tilting fulcrum shaft, said rocker arm main body having a pair of opposing wall portions which are tiltable by a cam to actuate a valve, said opposing wall portions each containing at least a cam receiver mounting portion for mounting said cam receiver between said opposing wall portions and a tilting fulcrum shaft mounting portion on each of said opposing wall portions for mounting said tilting fulcrum shaft between said opposing wall portions, each of said tilting fulcrum shaft mounting portions having a cylindrical expanding portion projecting out of the wall surface of said opposing wall portions in an axial direction of said tilting fulcrum shaft, wherein said rocker arm main body is formed of a single flat plate such that side portions thereof are formed of side walls rising substantially vertically from both sides of a bottom wall relative to said bottom wall and said side walls serve as said opposing wall portions.

2. A rocker arm comprising: a rocker arm main body; a cam receiver being drivable by cams mounted to a cam shaft of an engine; and a tilting fulcrum shaft, said rocker arm main body having a pair of opposing wall portions which are tiltable by a cam to actuate a valve, said opposing wall portions each containing at least a cam receiver mounting portion for mounting said cam receiver between said opposing wall portions, said cam receiver mounting portion being provided at one end of said rocker arm main body, and a tilting fulcrum shaft mounting portion on each of said opposing wall portions for mounting said tilting fulcrum shaft between said opposing wall portions, said tilting fulcrum shaft mounting portions being located between both ends of said rocker arm main body, each of said tilting fulcrum shaft mounting portions having a cylindrical expanding portion projecting out of a wall surface of said opposing wall portions in an axial direction of said tilting fulcrum shaft, wherein said rocker arm main body is formed of a single flat plate such that side portions thereof are formed of side walls rising substantially vertically from both sides of a bottom wall relative to said bottom wall and said side walls serve as said opposing wall portions.

3. A rocker arm, comprising:

a support shaft;

a cam receiver;

a tilting fulcrum shaft; and a rocker arm main body, said rocker arm main body being formed into a substantially U-shape comprising an intermediate wall and a pair of side walls formed on opposite side edges of the intermediate wall such as to extend in a direction intersecting at substantially right angles with each other such that said rocker arm main body is tiltable by a cam to actuate a valve, each of said side walls being provided with at least a cam receiver mounting portion for mounting said cam receiver between said opposing side walls, and a tilting fulcrum shaft mounting portion for mounting said tilting fulcrum shaft between said opposing side walls, said tilting fulcrum shaft mounting portion including a cylindrical expanding portion which projects inwardly between said opposing side walls from inner wall surfaces of said opposing side walls in an axial direction of said tilting fulcrum shaft which is in the mounted state, wherein said support shaft is penetratably inserted into and fixed to said cam receiver mounting portion, said cam receiver being formed by a roller fitted outwardly of said support shaft for rotation thereon.

4. The rocker arm according to claim 3, wherein in a state in which tip ends of said side walls extending from said intermediate wall are extended into a direction opposite from said valve, said cam receiver mounting portion and said tilting fulcrum shaft mounting portion are disposed on said side walls.

5. The rocker arm according to claim 4, wherein said intermediate wall is formed with an opening, a reinforcing member is provided such as to be astride said opening between said side walls.

6. The rocker arm according to claim 3, wherein in a state in which tip ends of said side walls extending from said intermediate wall are extended toward said valve, said cam receiver mounting portion and said tilting fulcrum shaft mounting portion are disposed on said side walls.

7. The rocker arm according to claim 5, wherein said intermediate wall is formed with an opening, a reinforcing member is provided such as to be astride said opening between said side walls.

8. The rocker arm according to claim 3, wherein said intermediate wall includes an expanding portion, said expanding portion including threads and a screw shaft threaded therein.

9. The rocker arm according to claim 8, wherein said expanding portion is formed by an increased thickness portion of said intermediate wall.

10. A rocker arm, comprising:

a support shaft;

a cam receiver;

a tilting fulcrum shaft; and a rocker arm main body, said rocker arm main body being formed into a substantially U-shape comprising an intermediate wall and a pair of side walls formed on opposite side edges of the intermediate wall such as to extend in a direction intersecting at substantially right angles with each other such that said rocker arm main body is tiltable by a cam to actuate a valve, each of said side walls being provided at one side thereof with at least a cam receiver mounting portion for mounting said cam receiver between said opposing side walls, and a tilting fulcrum shaft mounting portion for mounting said tilting fulcrum shaft between said opposing side walls, said tilting fulcrum shaft mounting portion including a cylindrical expanding portion which projects inwardly between said opposing side walls from inner wall surfaces of said opposing side walls in an axial direction of said tilting fulcrum shaft which is in the mounted state, wherein said support shaft is penetratably inserted into and fixed to said cam receiver mounting portion, said cam receiver being formed by a roller fitted outwardly of said support shaft for rotation thereon.

11. The rocker arm according to claim 10, wherein in a state in which tip ends of said side walls extending from said intermediate wall are extended into a direction opposite from said valve, said cam receiver mounting portion and said tilting fulcrum shaft mounting portion are disposed on said side walls.

12. The rocker arm according to claim 11, wherein said intermediate wall is formed with an opening, a reinforcing member is provided such as to be astride said opening between said side walls.

13. The rocker arm according to claim 10, wherein in a are extended toward said valve, said cam receiver mounting portion and said tilting fulcrum shaft mounting portion are disposed on said side walls.

14. The rocker arm according to claim 13, wherein said intermediate wall is formed with an opening, a reinforcing member is provided such as to be astride said opening between said side walls.

15. The rocker arm according to claim 10, wherein said intermediate wall includes an expanding portion, said expanding portion including threads and a screw shaft threaded therein.

16. The rocker arm according to claim 15, wherein said expanding portion is formed by an increased thickness portion of said intermediate wall.

* * * * *